United States Patent [19]

Wood

[11] 4,308,998

[45] Jan. 5, 1982

[54] MILLING, MIXING OR DISPERSING APPARATUS

[75] Inventor: Richard J. Wood, Warrington, England

[73] Assignee: Eiger Engineering Limited, Hertfordshire, England

[21] Appl. No.: 122,051

[22] Filed: Feb. 15, 1980

[30] Foreign Application Priority Data

Feb. 21, 1979 [GB] United Kingdom ..... 06131/79

[51] Int. Cl.[3] ..... B02C 17/10; B02C 23/02

[52] U.S. Cl. ..... 241/101 B; 241/101.2; 241/171; 366/137; 366/184; 366/264; 366/290; 366/318

[58] Field of Search ..... 366/157, 159, 176, 190, 366/262, 263, 264, 266, 290, 318, 319, 76, 79, 81, 82, 91, 99, 137; 241/101.2, 101.6, 171, 172, 101 B

[56] References Cited

U.S. PATENT DOCUMENTS

| | | | |
|---|---|---|---|
| 1,503,703 | 8/1924 | Moyle | 241/171 |
| 2,633,170 | 3/1953 | Balmain | 366/318 X |
| 3,942,773 | 3/1976 | Csongor | 366/82 |

FOREIGN PATENT DOCUMENTS

| | | | |
|---|---|---|---|
| 1249649 | 9/1967 | Fed. Rep. of Germany . | |
| 2432860 | 1/1976 | Fed. Rep. of Germany . | |
| 2321331 | 7/1976 | France . | |
| 613408 | 12/1960 | Italy | 366/79 |

*Primary Examiner*—Philip R. Coe
*Attorney, Agent, or Firm*—Larry S. Nixon

[57] ABSTRACT

Milling apparatus wherein material to be milled is agitated with a charge of particulate material also includes one or more predispersing chambers through which the material to be milled enters the apparatus. The chamber includes pumping means which carry out predispersing work.

13 Claims, 1 Drawing Figure

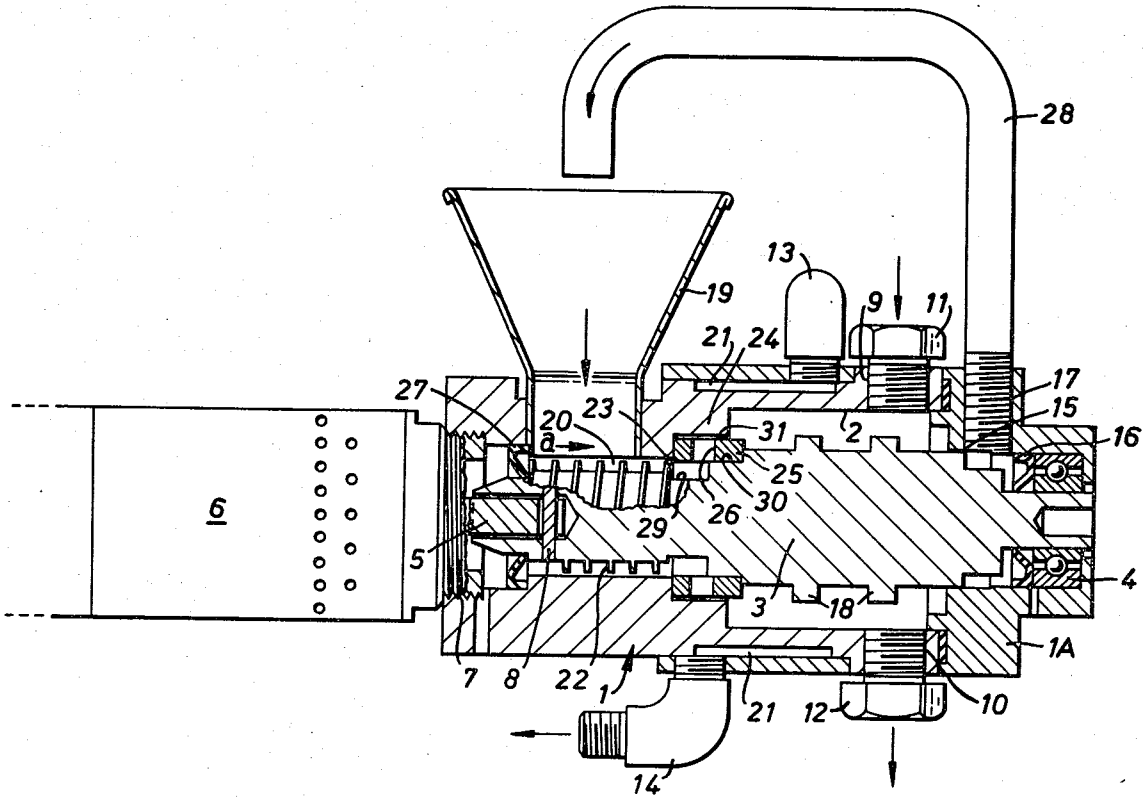
28
19
13
9
11
17
15
16
4
1A
10
2
24
21
31
25
30
26
29
23
20
d
27
5
6
7
8
22
1
3
18
12
21
14

MILLING, MIXING OR DISPERSING APPARATUS

DESCRIPTION

This invention relates to apparatus for milling, grinding, mixing, dispersing, emulsifying, homogenising and similar functions hereinafter referred to as milling apparatus of the kind specified. Apparatus of the kind specified comprises a milling chamber for containing particulate material such as granules or beads hereinafter termed the milling or grinding charge and agitating means for submitting this charge and material to be milled or otherwise treated within the chamber to intense agitating and shearing forces. These means typically comprise rotating impellers such as vanes, discs and paddles. In use the material to be milled is caused to flow through the milling chamber and to be submitted to the intense agitation and shearing forces in admixture with the particulate material. Such apparatus are conventionally referred to as "sand mills" or "agitated bead mills" depending on the nature of the particulate material and or the manufactures preference.

In existing apparatus of the kind specified it has been found necessary to predisperse the particles to be milled in a carrier fluid thereby providing a reasonably homogenous slurry which is a satisfactory input to the milling chamber. Additionally the slurry has to be pumped into the chamber. Thus at the present time a predisperser or homogeniser has to be provided together with a feed pump and this greatly increases the overall cost of the apparatus.

According to the present invention, apparatus of the kind specified includes the feed pump which also serves to predisperse the particles in the slurry to be milled immediately prior to the entry of the of the fluid to the milling chamber.

According to the present invention there is provided milling apparatus of the kind specified comprising a milling chamber for containing a charge of particulate material and agitating means for submitting the particulate material and the material to be milled to agitating and shearing forces characterised by at least one predispersing chamber and a feed pump associated with the agitating means such feed pump subjecting the material to be milled to centrifugal forces driving the product radially against the walls of the chamber thereby predispersing the material before the main milling operation and feeding the predispersed material into the main milling chamber.

The main shaft carrying the agitating means preferably also carries the predispersing and pumping members. In a preferred embodiment the input to the apparatus is through the wall of a first predispersing chamber. A rotating screw threaded member in the first chamber pumps and predisperses the material through to a second chamber carrying a pumping ring with an aperture to allow passage of material into the main milling chamber.

A specific embodiment of the invention will now be described by way of example and with reference to the accompanying drawing which is a longitudinal section.

The milling apparatus in accordance with the particular embodiment comprises a generally cylindrical body 1 with end member 1A defining a milling chamber 2. An agitator 3 is mounted as a shaft to rotate in the milling chamber 2 between a bearing 4 in the front end wall of the body 1 and the drive shaft 5 of an air motor 6. The air motor 6 is threadably received in a socket 7 in the rear end part of the body 1. The agitator shaft 3 is a slidable fit onto the air motor shaft 5 and is fixed thereto by a drive pin 8.

An inlet port 9 for the grinding charge of beads (not shown) is provided in the upper wall of body 1 and a corresponding outlet port 10 is provided in the lower wall, the ports 9 and 10 being closed by plugs 11 and 12. Inlets and outlets 13 and 14 respectively for cooling liquid are formed in the upper and lower walls respectively of the body and are interconnected by a circumferential cooling passage 21. The shaft 3 being closely adjacent the wall of the chamber 2 at 15 no specific means for preventing the axial exit of beads are required. Lip seal 16 behind front bearing 4 serves to retain material being milled which exits through threaded hole 17.

Agitating vanes 18 extend a short distance radially outwardly from the main shaft portion of agitator 3. This short radial excursion is sufficient to provide the milling forces required but does not define channels so deep as to provide "dead" zones wherein satisfactory milling does not take place. A funnel shaped inlet member 19 for product to be milled is provided in the upper part of the body wall and the lower end part of this communicates with an input chamber 20 in which the product is predispersed. A screw thread 22 extends along this chamber and is handed to drive product in the direction of the arrow "a" towards the milling chamber 2. The front end of the predispersing chamber opens into an annular space 23 defined by a shoulder 24 in the housing wall and a recess 29 in the rear part of the agitator 3. A pumping ring 25 provided with a plurality, for example six, radial holes 26 is a shrink fit on a step 30 on agitator 3 within annular space 23. The radially outer ends of holes 26 terminate a short distance from shoulder 24 leaving a narrow gap 31. A lip seal 27 closes the rear of predispersing chamber 20.

A doubly cranked product discharge pipe 28 is pivotally engaged into hole 17. Milled product can alternatively be recycled back to the product inlet 19 or drawn off.

In use of the device the bead charge is inserted through port 9 and cooling liquid circulated. The product to be milled is poured into inlet member 19 and enters predispersing chamber 20. The screw 22 carries out work on the product with the development of some centrifugal force which throws the product against the chamber walls. This work predisperses the particles in the product. The product then enters space 23 and is thrown radially outwardly through holes 26 in ring 25 into narrow space 31 and against the shoulder 24. More predispersing work is thus carried out and the annular space 23 can thus be regarded as a second predispersing chamber. The product then enters the main milling chamber 2 is milled and leaves through pipes 17 and 28 for discharge or recirculation.

In an alternative apparatus the main shaft 3 forms an extension of an electric motor shaft. This is in accordance with the teachings of our copending Patent Application No. 41436/77.

I claim:

1. Milling apparatus comprising:

a milling chamber having walls for containing a charge of particulate material and agitating means for submitting the particulate material and the material to be milled to agitating and shearing forces;

at least one predispersing chamber means for receiving and transporting material to be milled and a feed pump disposed between said chambers at the entrance of the milling chamber, such feed pump including means for carrying out further predispersing work on the material to be milled thereby substantially predispersing the material to be milled before the milling operation while simultaneously feeding the predispersed material into said milling chamber.

2. Apparatus as claimed in claim 1 wherein the feed pump includes plural radially outwardly extending passages which upon rotation subject the material to be milled to centrifugal forces driving it radially against the walls of the milling chamber.

3. Apparatus as claimed in either claim 1 or claim 2 wherein the means for transporting said material and said feed pump are carried by a shaft which also carries the agitating means.

4. Apparatus as claimed in claim 3 wherein said predispersing chamber means includes cylindrical walls and a rib extending along the respectively corresponding part of said shaft, said rib, when rotated, throwing the material to be milled against the walls of the predispersing chamber means.

5. Apparatus as claimed in claim 4 wherein said rib comprises a screw thread to cause the material to flow to the milling chamber.

6. Apparatus as claimed in claim 5 wherein said feed pump comprises a second predispersing chamber at the entrance of the milling chamber and also having cylindrical walls, said feed pump including a rotating pumping element with an aperture to cause centrifugal flow of fluid against the chamber wall of the second predispersing chamber and thence into the milling chamber.

7. Apparatus as claimed in claim 2 wherein the milling chamber comprises a shaft with agitating vanes, the said shaft having an outlet end running close to the milling chamber walls defining a space to allow outlet of milled material but not of the milling charge of particulate material.

8. Apparatus as claimed in claim 2 including an outlet pipe connected to said milling chamber and movable between a first position in which milled material is discharged and a second position wherein the milled material is recycled through the apparatus.

9. Milling apparatus of the type including an input chamber for receiving material to be milled and for passing it on to a main milling chamber where it and a charge of particulate material are subjected to agitation and shearing forces, wherein the improvement comprises:

a centrifugal pumping element disposed between said input chamber and said main milling chamber, said pumping element having at least one radially outwardly extending passage formed therein, and wherein said input chamber includes a ribbed element, said main milling chamber includes agitating means and further comprising a single rotatably mounted shaft carrying said ribbed element, said pumping element and said agitating means disposed sequentially along the longitudinal axis of said shaft.

10. Milling apparatus as in claim 9 further comprising:

an outlet pipe in communication with said main milling chamber and movable between a first position where milled material is discharged and a second position where milled material is recycled to the input chamber of the milling apparatus.

11. Milling apparatus comprising a main milling chamber for containing a charge of particulate material, agitating means for submitting the particulate material and the material to be milled to agitating and shearing forces, and an input chamber containing a ribbed element wherein the improvement comprises:

a predispersing chamber including an annular walled space between said input and milling chambers which space contains a centrifugal pumping element with at least one radially outwardly extending passage terminating in a narrow gap between the pumping element and the wall of the predispersing chamber.

12. Apparatus as claimed in claim 11 wherein the ribbed element, the pumping element and the agitating means are carried by a single shaft.

13. Apparatus as claimed in either claim 11 or claim 12 further comprising recycling means including an outlet pipe movable between a first position in which milled product is discharged and a second position wherein milled product is recycled through the apparatus.

* * * * *